US006483017B1

(12) United States Patent
Dill et al.

(10) Patent No.: US 6,483,017 B1
(45) Date of Patent: Nov. 19, 2002

(54) METHOD AND DEVICE FOR HYDRAULICALLY TENSING OF RELAXING A MEMBRANE OF A MUSICAL INSTRUMENT

(76) Inventors: Roman Dieter Dill, Revaler Strasse 99, D-10245 Berlin (DE); David Faulwasser, Diedenhofer Strasse 6, D-10405 Berlin (DE)

( * ) Notice: Subject to any disclaimer, the term of this patent is extended or adjusted under 35 U.S.C. 154(b) by 0 days.

(21) Appl. No.: 09/646,170

(22) PCT Filed: Jan. 14, 2000

(86) PCT No.: PCT/DE00/00173

§ 371 (c)(1),
(2), (4) Date: Sep. 14, 2000

(87) PCT Pub. No.: WO00/42597

PCT Pub. Date: Jul. 20, 2000

(30) Foreign Application Priority Data

Jan. 14, 1999 (DE) ..... 199 02 702

(51) Int. Cl.[7] ..... G10D 13/02
(52) U.S. Cl. ..... 84/411 R; 84/413
(58) Field of Search ..... 84/411, 413, 411 A, 84/421

(56) References Cited

U.S. PATENT DOCUMENTS 5,385,076 A * 1/1995 Beli ..... 84/414
5,392,681 A * 2/1995 Hall ..... 84/413
5,554,812 A * 9/1996 Donohoe ..... 84/413

* cited by examiner

*Primary Examiner*—Marlon T. Fletcher
*Assistant Examiner*—Kim Lockett
(74) *Attorney, Agent, or Firm*—Notaro & Michalos P.C.

(57) ABSTRACT

A method and apparatus for tensioning or relaxing a membrane of a musical instrument, such as a traditional frame drum. A pressurized fluid is guided into at least one variable pressure chamber formed by an expandable hollow body. The hollow body is positioned around the resonator of the instrument. The membrane is subjected to pressure between a membrane support and a membrane fixing device by means of the pressurized fluid in the chamber. Pressure is exerted evenly all around the circumference of the membrane. The membrane is fixed only by a band so that it can be tensed or relaxed very rapidly. The band is arranged to vibrate freely in relation to the resonance body while the membrane is subjected to pressure from the variably pressurized chamber.

26 Claims, 11 Drawing Sheets

METHOD AND DEVICE FOR HYDRAULICALLY TENSING OF RELAXING A MEMBRANE OF A MUSICAL INSTRUMENT

FIELD AND BACKGROUND OF THE INVENTION

This invention relates to a device for tensioning or relaxing a musical instrument's membrane, especially that of a single-drum-skin frame drum, such as Ceramic-Darabukka, Zarb, Buk, or Daiko type drums, as these traditional drums are known in their native languages. A liquid fluid is introduced into at least one variable pressure chamber formed by an elastically expandable hollow body outside the resonator of the drum. The membrane between a membrane base and a membrane fixing is evenly pressurized in a controlled manner and deformed as a bulge along its circumference by the liquid fluid introduced into the variable pressure chamber.

The invention further relates to a device for tensioning or relaxing a musical instrument's membrane, especially the membrane of a single-drum-skin frame drum, Ceramic-Darabukka, Zarb, Buk, Daiko, or the like, which lies on a membrane base and is connected with a membrane fixing especially provided at the musical instrument's resonator, and is at least partially pressurizable in a controlled manner between the membrane base and the membrane fixing by means of a liquid fluid which can be introduced into at least one variable pressure chamber.

It is known that temperature and humidity changes change the tension and mass of musical instrument's membranes. This applies in particular to traditional drums with animal drum skins, also known as natural drum skins, where the drum skin's tension and the pitch increase as a result of exposure to heat and low humidity.

The manner of fastening of traditional drum skins to a frame differs greatly. Drum skins are, for example, rigidly fastened by means of pegs, nails or bonding and then the desired tension is achieved using a heat source. It is also common to tension drum skins using strings, mainly with tension hoops, but this makes the tensioning of the drum skin and/or the tuning of the instrument or the replacement of the drum skin very time-consuming. Exact pitches are difficult to tune. Additionally, a limited range of tensions exists. As a result of the amplitude of vibration increasing under tension, the tensioning strings bring about an optimal vibration of the membrane and thereby, among other things, also a relatively large dynamic.

It is also known to tension drum skins on traditional drums with interlocking mechanical elements such as, e.g., rods and tensioning lugs or two tension hoops with opposing threaded connections etc. Although tension rods make the tensioning process easier, additional tension hoops, preferably make of metal, are required because the point force transmission requires a relatively strong, stiffened mechanism when tension is put upon the drum skin by means of tension rods.

As a result, such a tension mechanism often accounts for the largest portion of the drum's weight. In addition, the stiffened membrane pick-up limits the membrane vibration and produces a reduced dynamic, among other effects. The relatively heavy tension mechanism has to be fastened at the resonator of the drum which results in an unwanted damping because of the increased weight and the rigid connection. This has a negative influence on the sound. Further, secondary noise occurs, such as distortion and sound spectrum parts which are foreign to the resonator are generated.

The protruding elements of the tension mechanism can cause injuries from physical contact. The risk of injuries to hands, especially the wrists, is relatively high for beginners or when the drums are strongly beaten.

In order to obtain the required torsional strength of the resonator in the area of the tensioning lugs, a relatively high strength of materials or a relatively high strength of the resonator is required. Brittle materials such as ceramic, glass, soft wood etc. are not suitable for the resonator because of the point load of the tension mechanism. That is why, for example, the modern embodiment of a Darabuka, which traditionally is of ceramic, is now commonly made of aluminum with tension rods.

The required number of tension rods increases with an increasing drum diameter. In order to guarantee, for example, that a tympani can be exactly tuned, an expensive and relatively heavy tension mechanism has to be used, despite the disadvantages described above.

Natural drum skins wear out faster at a permanently high tension load and when exposed to heat and air humidity changes. Their period of use maximally comprises 20% to 25% of a day. The mentioned known tensioning devices or mechanisms do not guarantee a quick tensioning and tuning of natural drum skins, and that is why this is seldom done in practice.

Even though the problem of adverse heat and air humidity influences is resolved by the conventional use of synthetic skins, there are drawbacks. Synthetic skins have a vibration behavior with a lower dynamic and unpleasant overtone spectra, due to their inherent elasticity and stiffness in comparison with natural drum skins.

A device for tensioning skins on drums, banjos, and other musical instruments, as described in German Patent 109, 902, is known which consists of an inflatable tube of any material which is fastened to the instrument. The tube is fastened in such a manner that in its inflated condition, the fastened skin is tensioned. The rim of the drum skin is held pulled over the inflatable tube always using one tensioning hoop, equipped with tension rods. The diameter of the hoop can be reduced whereby the drum's weight is undesirably increased and, as well, the risk exists that the hands of persons playing the drum will be injured. The exchange of the drum-skin is relatively time-consuming.

U.S. Pat. No. 5,392,681 describes a device for tuning a drum having the membrane-like drum skin secured at the resonator by a tension mechanism formed by a metal tensioning hoop lying on the drum-skin and tension rods distributed along the hoop circumference in contact with the resonator of the drum. The device further includes a flexible, bladder-like ring element clamped under the hoop and which is controllably inflatable for the tuning of the drum by means of a liquid fluid.

The tuning device of U.S. Pat. No. 5,392,681 has the disadvantage that the inflatable ring element, which forms a variable pressure chamber, is especially compressed in the region of the tension rods between the tensioning hoop and the drum membrane lying on a membrane base at the resonator. Thus, an even pressurization of the drum membrane between the membrane base and the membrane fixing at the resonator is not provided by the inflated flexible ring element along the membrane's circumference. The drum membrane is evenly pressurized by the flexible ring element only when this element is inflated between its compression points which are spaced at specific distances along the ring element's circumference. This well-known drum experiences many of the above mentioned disadvantages caused by excessive weight from the tension mechanism, including the undesired damping of the vibration, the point and/or stiffened force transmission and the time-consuming replacement of the drum skin.

SUMMARY OF THE INVENTION

The invention provides a process and device for tensioning and relaxing an instrument membrane which is easier and faster than prior devices for controllably tensioning or relaxing a musical instrument's membrane. The invention is especially provided for tensioning and relaxing the membrane of a single drum skin frame drum, such as a Ceramic-Darabukka, Zarb, Buk, or Daiko, without using a traditional tensioning and securing mechanism, and to make changing the membrane relatively fast and uncomplicated while producing an exact intonation of the musical instrument as possible.

At the same time, it is a goal of the invention to reduce the risk of injury from percussion instruments for which are wholly or partially played by fingers and to enhance playing comfort.

Additionally, the traditional design of drums without tensioning device has to be retained when the above mentioned goals are attained.

Further, the presumably oldest known type of drum, the single-drum-skin frame drum, shall be equipped with an effective tuning device, weighing as little as possible, having a high vibration capacity, and, if possible, using a reduced number of components.

According to the invention, the objects of the invention are achieved in a surprisingly simple manner by fixing the membrane using only a hoop which, at the pressurization of the membrane, is secured to the resonator free of permanent fasteners. The hoop is secured using a liquid fluid introduced into a variable pressure chamber to trap the hoop against the resonator.

By pressurizing the inner or outer membrane area between a membrane base and a membrane fixing, the hoop for securing the membrane is preferably held free to vibrate in relation to the resonator by the liquid fluid introduced into the variable pressure chamber, whereby the membrane between the membrane base and the membrane fixing is distinctively deformed as a bulge towards the outside or the inside.

It is appropriate to apply a lubricant to the membrane base to provide for an even equalization of tension within the membrane whenever it is deformed. The membrane can also easily be secured by either glueing, bonding and/or nailing of the membrane or affixing it at the rim of the resonator opposite to the membrane base and/or at the inner surface of the resonator.

But, the pressurization of the membrane between the membrane base and the membrane fixing is preferred instead of directly effecting this using the liquid fluid introduced into the variable pressure chamber via a separate, elastically expandable, hollow body.

The described goals are further advantageously solved by a device for the tensioning and relaxing of a musical instrument's membrane arranged so that the membrane forms at least the wall-section of the variable pressure chamber by which the volume-like variability of the pressure chamber is provided. And, the pressure chamber is controllably deformable to take the shape of a balloon which is evenly formed along the circumference of the membrane at least along the circumferential range of the membrane's action.

The wall of the variable pressure chamber can preferably be entirely formed of the membrane. The wall of the variable pressure chamber can also be fastened at a membrane fixing which is at a specific distance from the resonator and lies against and seals the resonator with its section extending on the other side of the membrane fixing below the membrane base area, and with its outer area the end of the section at the membrane base area. The membrane rim can either be simply glued or bonded to the resonator and/or fixed by means of nails, tacks, pins, screws or the like and be directly connected with the rim opposite to the membrane base and/or the inner surface of the resonator.

The described objects are further solved by a device for the tensioning or relaxing of a musical instrument's membrane wherein the liquid fluid can be introduced into a variable pressure chamber formed by an elastically expandable hollow body in which the drum skin, forming the membrane and placed on the resonator is preformed in a hat-shape. The drum skin is, at its rim, closed in a hoop, the internal diameter of which is slightly larger than the external diameter of the resonator. The drum skin membrane lies against the pressurized hollow body which forms the variable pressure chamber in such a manner that the hollow body holds the membrane freely vibratable in relation to the resonator and fixes the rim of the membrane on which tension is put upon by the hollow body.

The hoop is preferably held in its place under tension in relation to the resonator between the pressurized hollow body and the inner surface of the tensioned membrane whereby the rim of the tensioned membrane is held tightly fixed by the hoop against the outer wall of the resonator. The rim of the tensioned membrane can also be secured at the lower end of the hoop which forms an outer enclosure of the hollow body pressurizing the outer surface of the membrane and which is kept freely vibratable by the hollow body in relation to the resonator. A lubricant is preferably applied on the membrane base to provide a simple and reliable manner for obtaining even equalization of tension within the membrane, which is adapted to the pressurization of the latter.

A process for the tensioning or relaxing of a membrane is provided for the tuning of at least one string (of a musical instrument) positioned above the musical instrument membrane. The string is at least secured and tensioned with one end at the membrane. Alternately, a process is provided for tensioning or relaxing at least one string under tension positioned above the membrane on at least one bridge on the membrane.

The all-area and flexible transmission of force of at least one variable pressure chamber which is filled in a controlled manner with compressed air ensures an even exchange of tension within the membrane of a drum. An exact intonation can thus be directly achieved by simply changing the pressure in the hollow body forming the variable pressure chamber so that instruments can be tuned exactly and in rapid succession. The spontaneously available ability to be tuned offers a multitude of sound which otherwise calls for new and additional instruments.

Some percussion instruments, such as the Indian Tabla, Conga, Bongos, or Darabuka for example, are mainly tuned to defined tonal context in professional use. An ability to change the tone of the drum while playing was hitherto possible only with the timpani. Using the device according to the invention, to effect a manually, analogously, or digitally controlled pressure change of the variable pressure chamber, it is now possible to directly retune all drums while playing.

For example, it is now possible, using the invention to produce an increased skin tensioning, to distinctly introduce a virtuoso solo interlude and to subsequently play a normal accompaniment with a tonally adjusted lower tensioning using the same instrument. Since the invention makes available a more comprehensive range of tones, it is also possible to make greater use of instruments which are traditionally equipped with a limited range of tuning.

When opening one or more control valves of the variable pressure chamber, a relaxation of the membrane can take place within the shortest possible time by the outflow of air. That is, the internal pressure of the variable pressure chamber adapts to that of the outside pressure. After playing, skins or membranes can thus be protected by reducing their load and they can be used for a longer period of time. This load reduction regenerates the elasticity of natural drum skin, i.e. the drum skin tensioning, which occurs after the load reduction, gradually increases. Since natural drum skins reach their optimal sound only after an extended period of vibration harmonization, a longer usability of the natural drum skins thus leads to enhancement of the instrument sound.

The presence of one or more flexible pressure chambers ensures a vibrating absorption of force by the membrane tension. This produces an optimal vibration behavior and a great dynamic, as is already provided by a string device.

Independent of their forms, the invention can be used for all types of membranophones just as advantageously as for chordophones, the sound board of which is formed of a membrane.

The distinctive round bulge of the drum skin rim forms a resilient base area for a player's hands and does not impair their playing position. Since the setup and the arrangement of the device for the tensioning or relaxing of the musical instrument's membrane in accordance with the invention do not affect the appearance of the musical instrument, up-to-date requirements regarding the ability of, for example, traditional instruments to be tuned can also be fulfilled while maintaining their original design.

The variable pressure chamber is preferably formed of a commercially available tire tube, so that the tensioning device adds very little to the drum weight. This is of particular importance for a frame drum because it is played and held with one hand at the same time. The force of the membrane tension is evenly transferred along the physical tension force line of the resonator to the latter, by which action the resonator is stabilized contrary to a traditional tension mechanism with tension rods.

Securing and tensioning the membrane in accordance with the inventive process makes a fast exchange of drum skins possible, and provides for a low-weight frame drum which can be safely handled because bulky lock or tensioning hoops are not necessary to secure the drum skin rim.

A resonator can be used for various sound requirements, because of the relatively large sound variability of natural drum skins. Now drums with exchangeable drum heads can be introduced on the market for various sound creations. And, due to the. existing selection of exchangeable drum heads, the ability to change the sound of drums is transferred from the producer to the musician. Worn out skins can now be replaced within minutes, avoiding costly repair work. Replacement drum skins thus offer musicians insurance which before now could only be guaranteed by having spare instruments available.

The drum skins can be taken off the resonator and stacked for transportation. This can, for example, mainly benefit large drums such as the timpani. For drums with closed resonators, additional room is thereby created. The drum skin representing the smallest and most sensitive part of a drum can thus be separately packed.

The very simple setup of the device in accordance with the invention meets all demands of the optimal tensioning or relaxing of membrane-like elements or membranes, it can be produced at low cost, and this applies especially also to already used traditional musical instruments by means of retrofitting at relatively low costs.

The process in accordance with the invention is especially suitable for all musical instruments of membranophone make. That is, the process is applied most frequently to a general embodiment of a musical instrument with an external groove in the resonator below the membrane base and a tube embedded in this groove which when not filled does not protrude over the rim of the groove. The drum skin forming the membrane is preformed in a hat-shape and closed at the rim by the hoop, as discussed above. As noted, the internal diameter of the hoop is slightly larger than the external diameter of the resonator. The drum skin is placed on the resonator whereby the drum skin walls form the outer enclosure of the tube and position the hoop below the groove. The tube is inflated with compressed air, resulting in the membrane between the membrane base and the membrane fixing being deformed to form a roll towards the outside along its entire circumference by the pressure of the tube. The membrane is thus tensioned and the hoop is held fast against the resonator by the tube. A simple bicycle or car air pump can serve as a source of compressed air.

The device in accordance with the invention is especially suitable for making lightweight frame drums because a separate hoop is not needed, in contrast to known drums with other tensioning devices. The drum skin is directly connected with the rim opposite to the membrane base and/or the inner surface of the resonator. This connection is primarily achieved by glueing or bonding which can be combined with elements such as nails, tacks, pins, screws and the like. This construction provides a very simple system for a tunable frame drum having three elements: a drum skin, a frame, and a commercially available tire tube. The present invention is impressive in its surprising simplicity by means of which the many-thousand-year-old playing position of the frame drum, for which historical evidence exists, can be maintained since the tuning device in accordance with the invention accounts for a negligible weight increase only.

DESCRIPTION OF THE PREFERRED EMBODIMENTS

Figure 1:
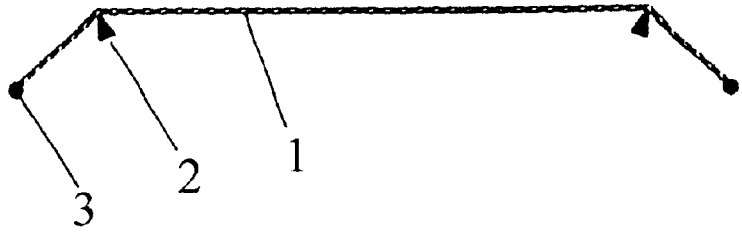
FIG. 1 is a schematic cross-sectional view of a membrane with a circular horizontal layout, lying on a membrane base and fastened to a membrane fixing.

FIG. 1 shows a schematic sectional view of a membrane 1, the horizontal layout of which is assumed to be circular. The membrane 1 lies on a membrane base 2 and is fastened at its circumference at a membrane fixing 3. In accordance with the invention, the entire membrane 1 is evenly pressurized along its whole circumference between the membrane base 2 and membrane fixing 3.

Figure 2:
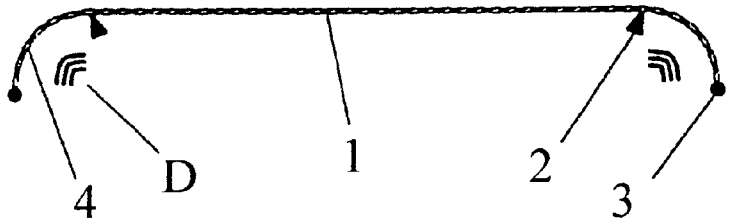
FIG. 2 is a schematic view of the membrane in accordance with FIG. 1, at a pressurization of the inner membrane surface between the membrane base and the membrane fixing.
Figure 3:
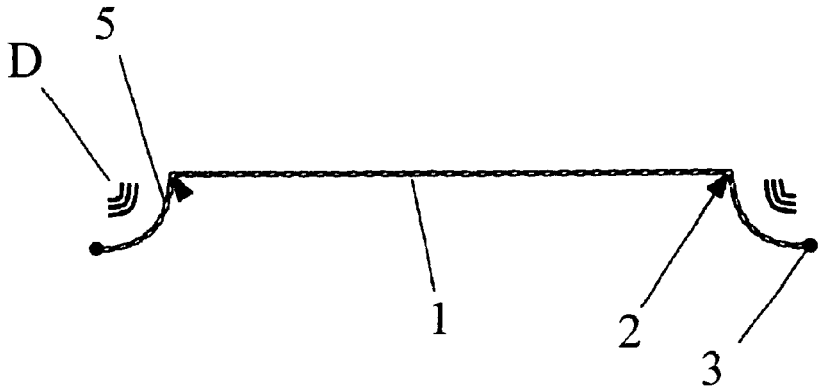
FIG. 3 is a schematic view of the membrane in accordance with FIG. 1, at a pressurization of the outer membrane surface between the membrane base and the membrane fixing.

FIGS. 2 and 3, which are to be viewed in connection with FIG. 1, show that the entirely even pressurization takes place between the membrane base 2 and the membrane fixing 3. The membrane fixing 3 is provided along the membrane 1 circumference in accordance with the invention on the inner surface 4, or base area, of the membrane 1, as shown in FIG. 2. Alternatively, the membrane fixing is on the outer surface 5 of the membrane 1, as seen in FIG. 3. The membrane 1 between the membrane base 2 and the membrane fixing 3 is distinctively deformed as a bulge towards the outside (FIG. 2) or towards the inside (FIG. 3).

Figures 4A, 4B, 4C, 4D, 4E:
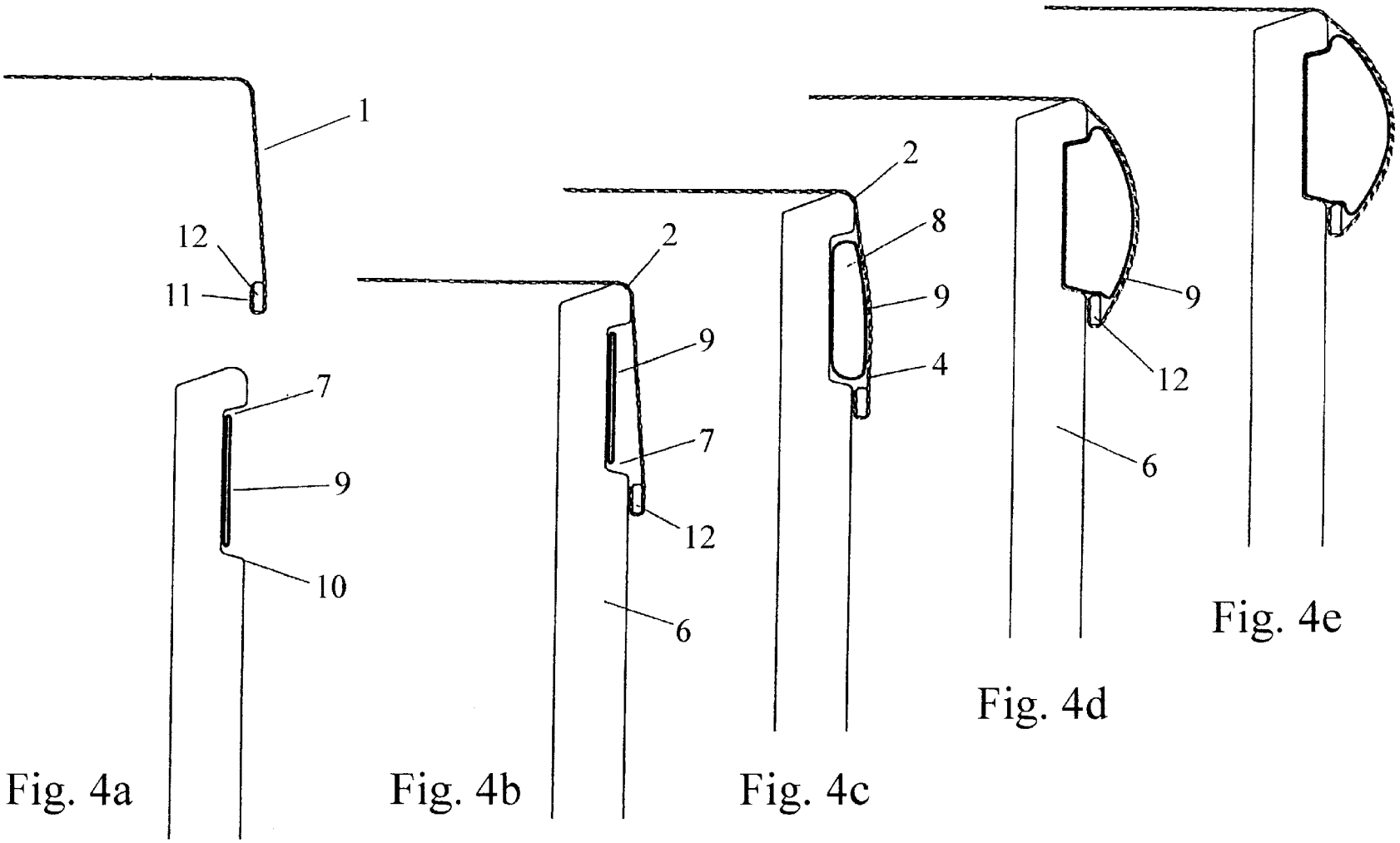
FIGS. 4*a*–4*e* are schematic sectional views which sequentially illustrate the assembly and function of a first embodiment of the device.

FIGS. 4*a*–4*e* sequentially illustrate the assembly and the function of a first embodiment of the device. As seen in FIG. 4*a*, a groove 7 is provided externally on a resonator 6 below the membrane base 2. A tube 9 is embedded in the groove 7. The tube 9 forms a variable pressure chamber 8, that is inflatable by means of a compressed air source (not shown). In the deflated condition, the tube 9 does not protrude, or extend, over the rim 10 of groove 7.

The membrane 1 is preferably a skin which is preformed in a hat-shape and enclosed at the membrane rim 11 by a hoop 12, as shown by FIGS. 1, 4*a*. The internal diameter of the hoop 12 is minimally larger than the external diameter of the resonator 6.

As next seen in FIG. 4*b*, the drum skin is placed on top of the resonator 6 in such a manner that it runs over the membrane base 2 formed by the resonator 6 and forms an outer enclosure for the tube 9 arranged in the groove 7. The hoop 12 is positioned below the groove 7 adjacent the resonator 6. FIGS. 4*c*–4*e* sequentially show the inflation of membrane 1 through progressive deformation stages as compressed air is supplied to the tube 9. The tube 9 forms the variable pressure chamber 8, so that as tube 9 expands, it pressurizes the membrane 1 between the membrane base 2 and the membrane fixing 3 along the membrane's circumference on the inner area 4, or membrane base area (FIG. 4*c*). The tube 9 deforms into a roll towards the outside of groove 7 because of its increased internal pressure and the membrane 1 is thus tensioned. The hoop 12 is held fast by the inflated tube 9 freely vibratable relative to the resonator 6 (FIGS. 4*d* and 4*e*).

Figure 5:
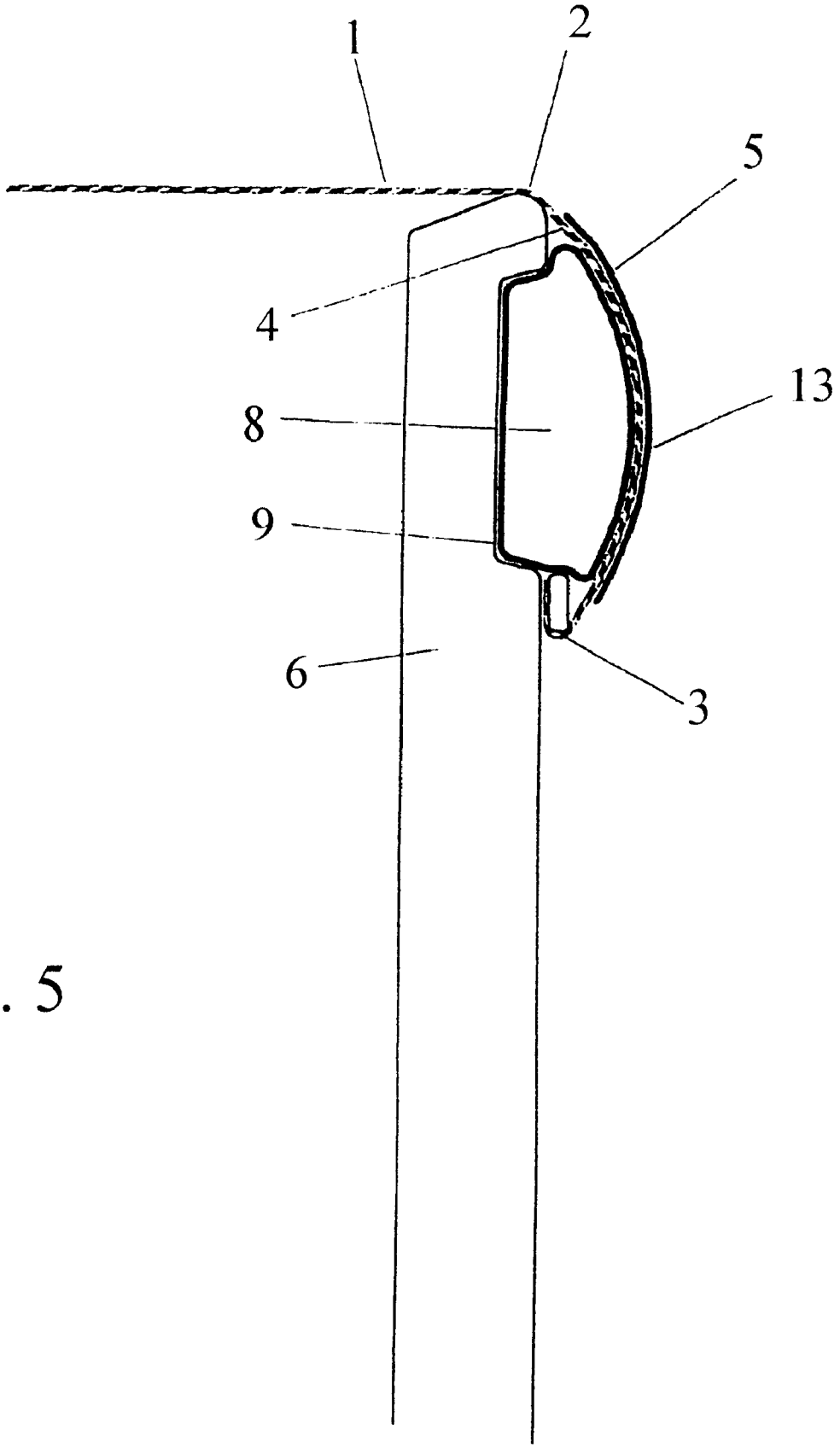
FIG. 5 is a schematic sectional view of a second embodiment of the device, the principal function of which corresponds to that of the first embodiment.

FIG. 5 shows a second embodiment of the device, the principal operation of which corresponds to that of the first embodiment. Tube 9 forming the variable pressure chamber 8 pressurizes the inner area 4, or membrane base area, of the membrane 1 between the membrane base 2 shaped by the resonator 6 and the membrane fixing 3. In the embodiment of FIG. 5, a band or a ring 13, preferably made of metal, wood, or plastic, is provided at the outer area 5 of the membrane 1 in the deformable area between the membrane base 2 and the membrane fixing 3. The band or ring 13 extends downwardly, or in the direction of the circumference of membrane 1. The band or ring 13 is elastically expandable and directly placed on the outer area 5 of the membrane 1, or arranged by means of an elastically expandable bearing 14 on the external area 5 of membrane 1 so that membrane 1 is protected against damage.

Figure 6:
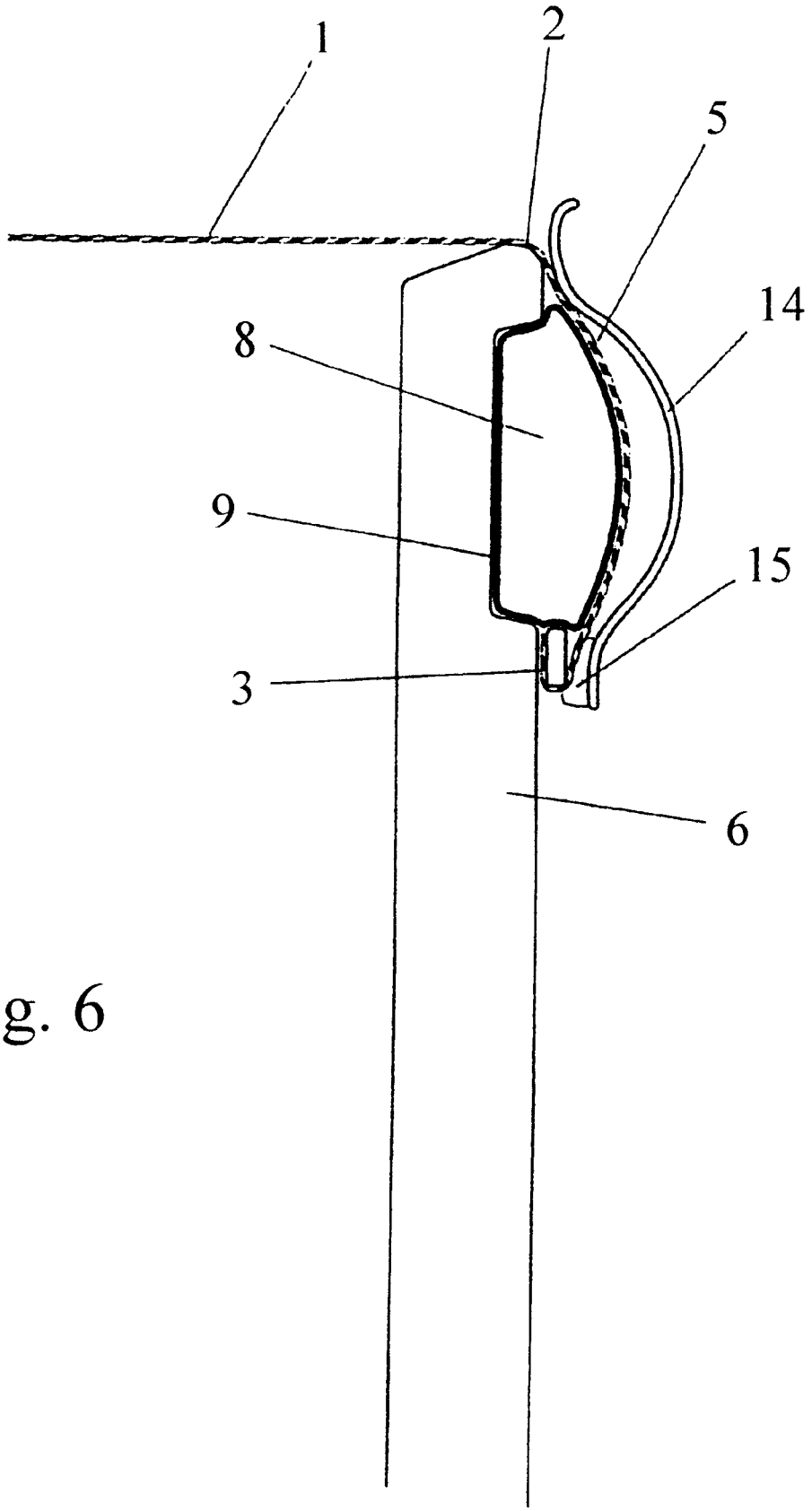
FIG. 6 is a schematic sectional view of a third embodiment of the device, the principal function of which corresponds to that of the first embodiment.

FIG. 6 shows a third embodiment of the device, the principal operation of which corresponds to that of the first embodiment in FIGS. 1–4*e*. In the embodiment of FIG. 6, a stiff hoop 14 which extends at least partly in the direction of the circumference of membrane 1, and deformed into an outward bulge, is placed on the outer area of membrane 1. The stiff hoop 14 is held in place by an elastic bearing 15 positioned in the deformable area between the membrane base 2 and the membrane fixing 3. Hoop 14 is used to produce special rim shots.

Figure 7:
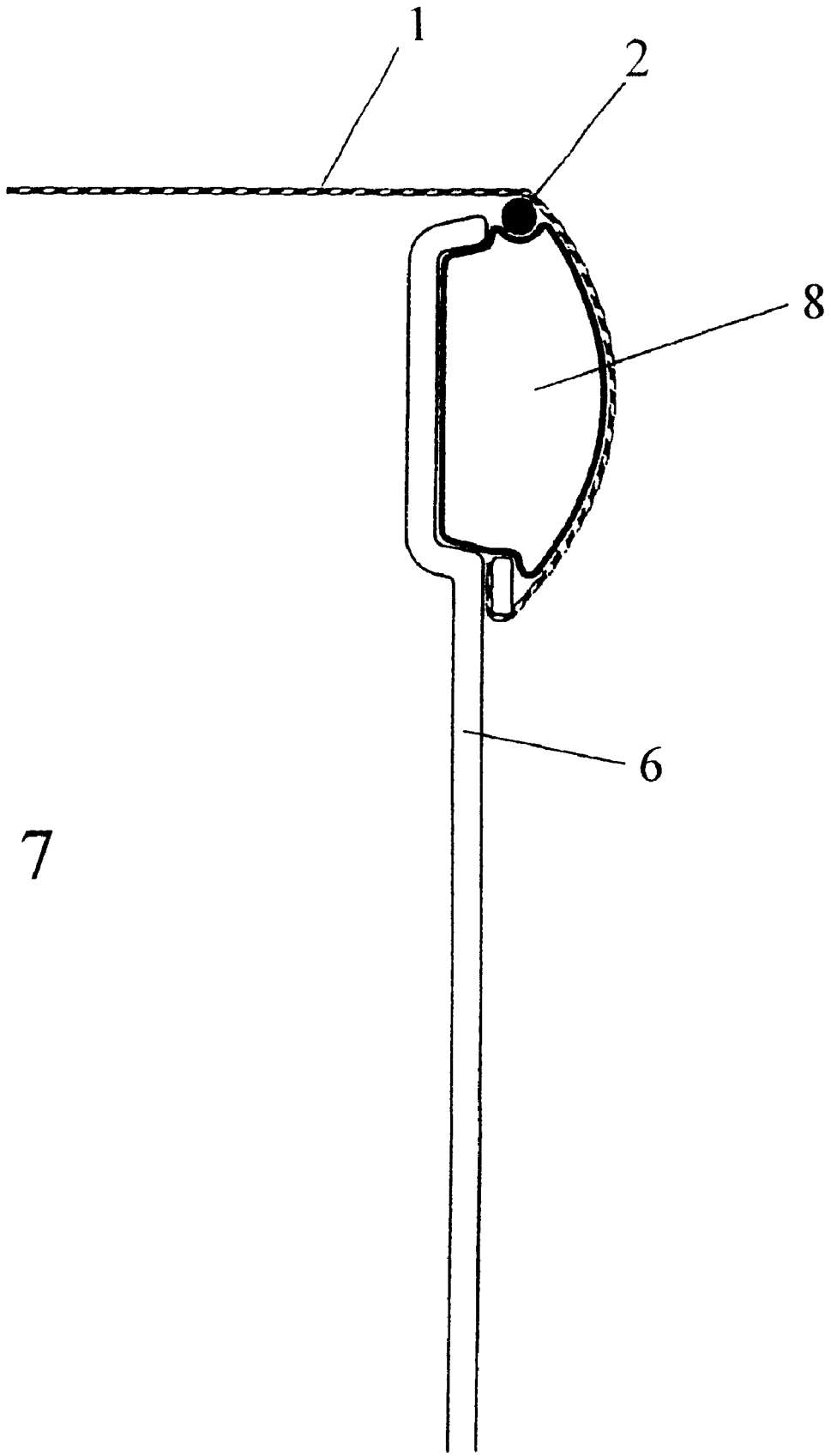
FIG. 7 is a schematic sectional view of a fourth embodiment of the device, the principal function of which corresponds to that of the first embodiment.

FIG. 7 shows a fourth embodiment of the device which is similar to that of FIG. 4*e*, the principal function of which corresponds to that of the first embodiment. As seen, membrane 1 lies on a membrane base 2 which is spaced a particular distance from the resonator 6.

Figure 8:
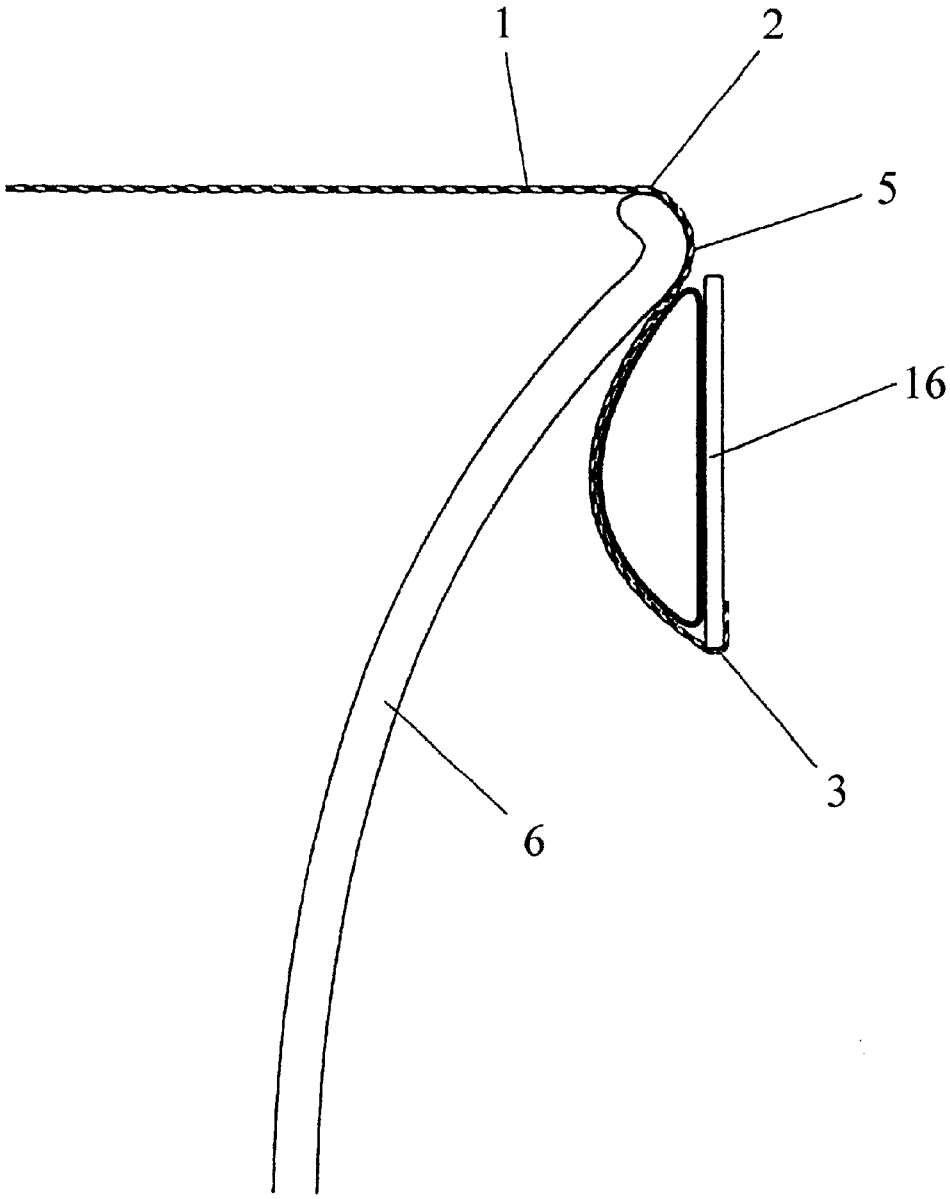
FIG. 8 is a schematic sectional view of a fifth embodiment of the device, the principal function of which corresponds to that of the first embodiment.

FIG. 8 shows a fifth embodiment of the device, in which the membrane base 2 is again formed by the resonator 6. The membrane 1, which is above the membrane base 2, is turned outwardly away from the resonator 6 at the outer area 5. A membrane holder 16 connected to membrane fixing 3 is arranged spaced a particular distance from the resonator 6 and secured. The tube 9 forming the variable pressure chamber 8 lies against a side of the membrane holder 16 which faces the resonator 6. When tube 9 is inflated with compressed air, the outer area 5 of the membrane 1 is entirely evenly pressurized along the membrane circumference, so that membrane 1 is strongly deformed as a bulge towards the resonator 6 in the region between the membrane base 2 and the membrane fixing 3 and tensioned thereby.

Figure 9:
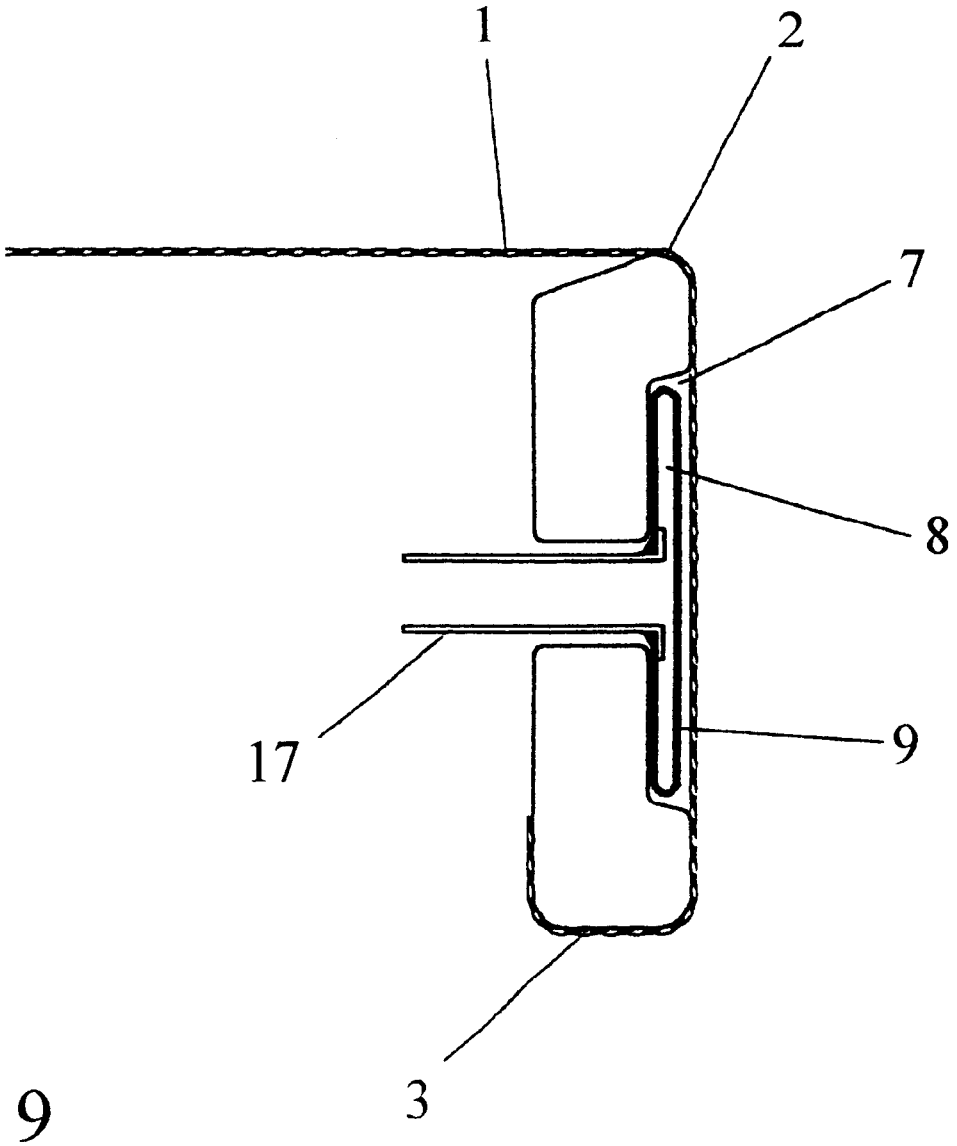
FIG. 9 is a schematic sectional view of a sixth embodiment of the device, the principal function of which corresponds to that of the first embodiment.

FIG. 9 shows a sixth embodiment of the device in which the groove 7 holding the tube 9 forms a frame consisting of two parts. The groove 7 is positioned below the membrane base 2, which is located over the upper frame portion. The portion of membrane 1 extending past the membrane base 2 forms an external enclosure for tube 9 defining the variable pressure chamber 8. The membrane 1 and is fixed at the rear of the lower frame part. The principal operation of this sixth embodiment of the device corresponds to that of the first embodiment.

Figure 10:
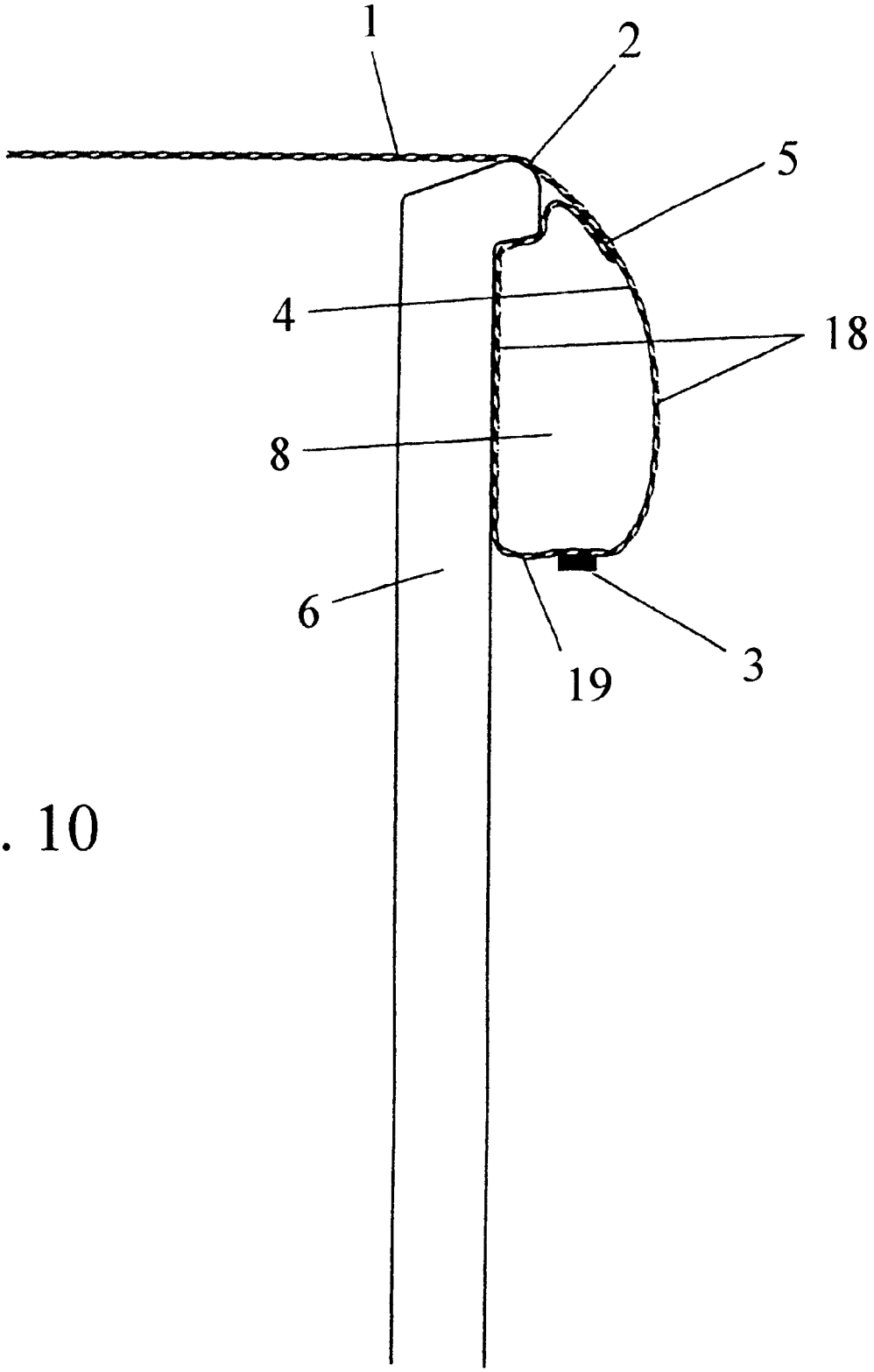
FIG. 10 is a schematic sectional view of a seventh embodiment of the device in which the variable pressure chamber is formed by the membrane.

FIG. 10 shows a seventh embodiment of the device in which the membrane 1 extending past the membrane base 2 formed over the resonator 6, defines the whole wall 19 of the variable pressure chamber 18. The membrane 1 is held with membrane fixing 3 spaced a particular distance from the resonator 6. The membrane 1 lies against the resonator 6, which extends on the other side of the membrane fixing 3 below the protruding membrane base 2. The membrane 1 forms a seal with its outer area 5 contacting its inner area 4, or membrane base area.

When introducing the liquid fluid into the variable pressure chamber 18, the inner area 4 of the membrane 1 is, in this preferred embodiment of the device, directly entirely evenly pressurized along the circumferential edge, thereby strongly deforming as a bulge towards the outside. In this manner, membrane 1 is tensioned.

Figure 11:
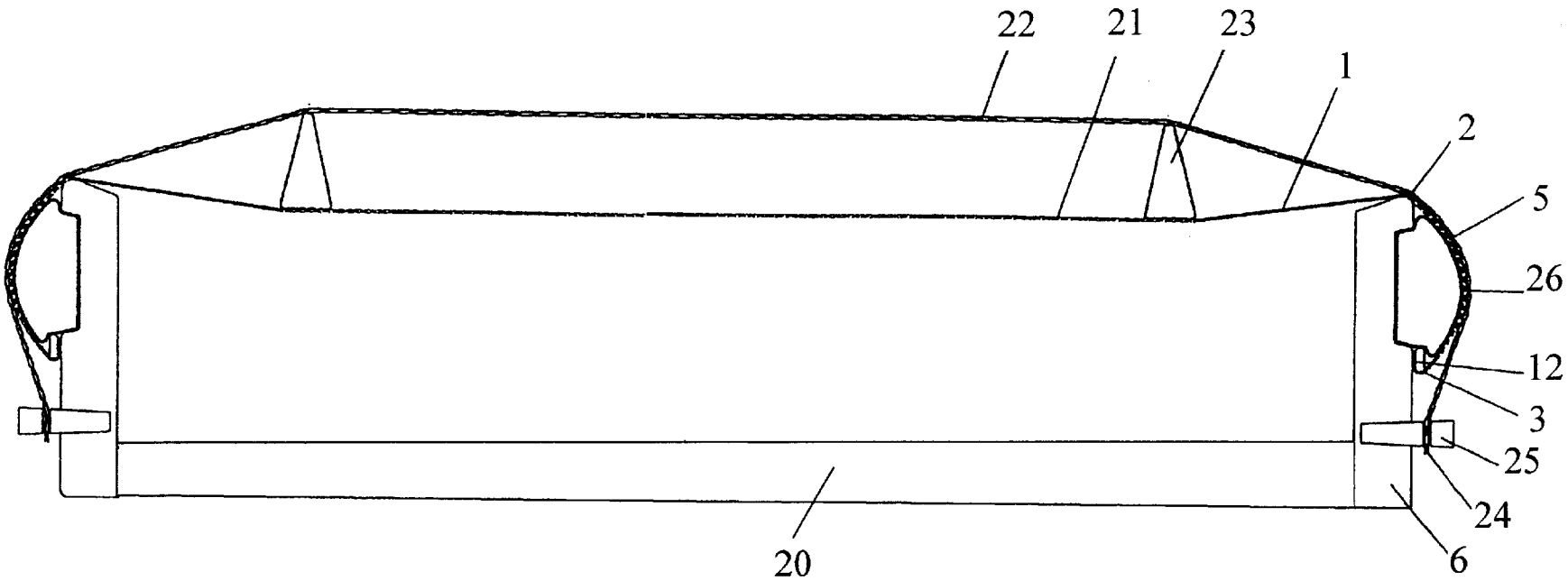
FIG. 11 is a schematic sectional view showing the use of the device in accordance with the principal function of the first embodiment for the tuning of at least one string of a stringed instrument.

The schematic view of FIG. 11 shows a zither-like stringed instrument 20, the sound board 21 of which is formed by a membrane 1. Membrane 1 can be tensioned and relaxed using the first embodiment of the device in accordance with FIG. 5, above, the principal operation of which has been described.

In FIG. 11, at least one string 22 running above the membrane 1 rests on opposite points of a double bridge 23 which supported on the sound board 21, formed by the membrane 1. The string 22 can be tensioned or relaxed on the stringed instrument 20 and is secured at each of its ends 24 by a circular tuning peg 25. The tuning pegs 25 are connected to the resonator 6 below the tensioning device. The string is held in such a manner that the string 22 lies on the outer area 5 of the membrane 1 in the area of the membrane's 1 distinctive outward bulging 26 between the membrane base 2 formed by the resonator 6 and the membrane fixing 3 formed by hoop 12. Thus, the string 22 and can be changed in its tuning by the tensioning or relaxing of the membrane 1 by means of the tensioning device.

The process for the tuning of the strings 22 of a stringed instrument 20 such as shown in FIG. 11 is of particular advantage for stringed instruments in which the sound board of the resonator is formed by a membrane 1 which can be tensioned or relaxed by means of a tensioning device. The process is especially useful for instruments which are equipped with a board grip, since at the tensioning or relaxing of the membrane, the height of the strings which are stretched over the bridge above the membrane can simultaneously be brought into a relation which is in conformity with the ratio of height required for the exact fine tuning of the instrument.

Figure 12:
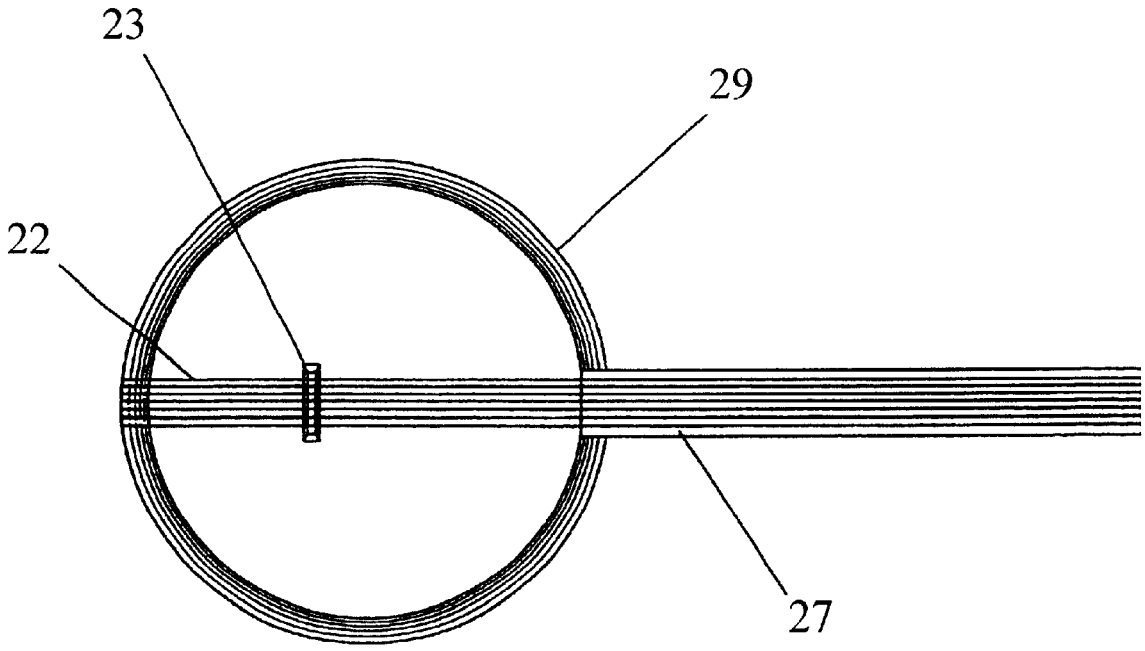
FIG. 12 is a horizontal projection of a schematic view of a banjo on which the process of the invention is used for the membrane's tensioning or relaxing.
Figure 13:
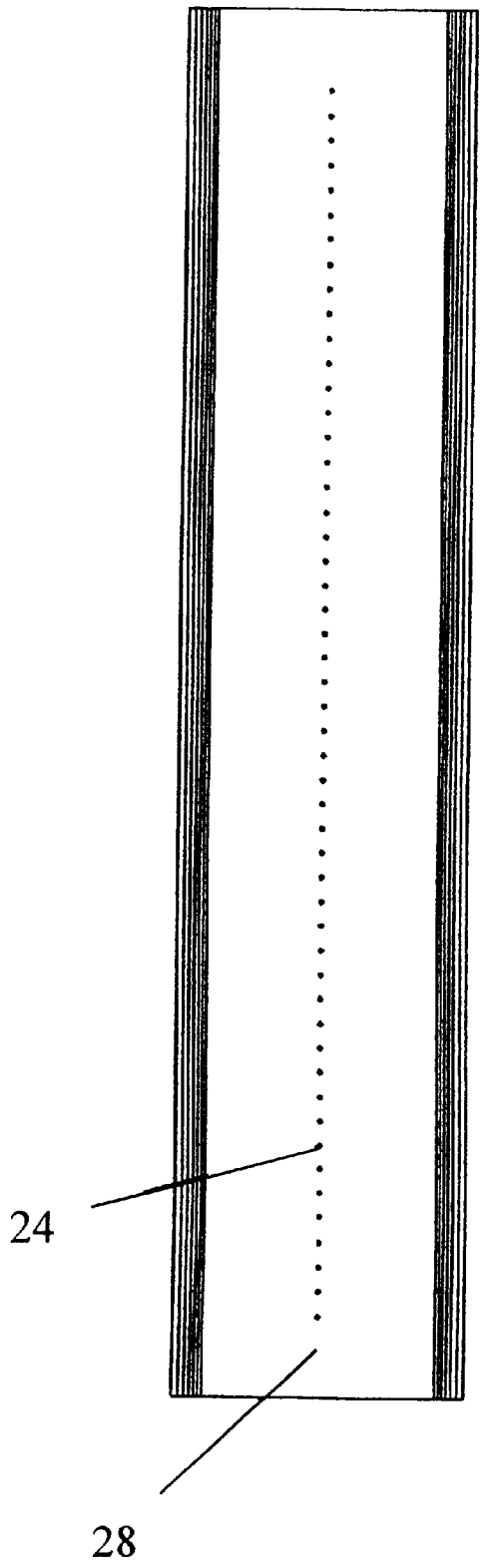
FIG. 13 is a schematic sectional view of a harp, seen along the axis of the harp's strings on which the process of the invention is used.

FIGS. 12 and 13 illustrate the use of the device for the tensioning and relaxing of a membrane at the example of a banjo 27 or a harp 28, whereby the membrane base, the membrane holder, and the variable pressure chamber are formed as an incomplete ring 29 or in two pieces.

What is claimed is:

1. A process for tensioning or relaxing a membrane of a musical instrument, especially a single-drum-skin frame drum, in which a liquid fluid is introduced in a controlled manner into at least one variable pressure chamber formed by an elastically expandable hollow body outside the resonator of the drum and the membrane positioned between a membrane base and a membrane fixing, the liquid fluid evenly pressurizing and deforming the at least one variable pressure chamber into a bulge along its circumference, comprising securing the membrane using only one hoop held freely vibratable relative to the resonator following evenly pressurizing and deforming the at least one variable pressure chamber.

2. The process according to claim 1, further comprising deforming an inner area of the membrane between the membrane base and the membrane fixing as an outward bulge by pressurizing the inner area.

3. The process according to claim 1, further comprising deforming an outer area of the membrane between the membrane base and the membrane fixing as an outward bulge by pressurizing the outer area.

4. A process for tensioning or relaxing a membrane of a musical instrument, especially a single-drum-skin frame drum, in which a liquid fluid is introduced into at least one variable pressure chamber and the membrane between a membrane base and a membrane fixing is evenly pressurized in a controlled manner along its circumference, comprising pressurizing the membrane between the membrane base and the membrane fixing directly using the liquid fluid introduced into the at least one variable pressure chamber.

5. The process according to claim 4, further comprising applying a lubricant to the membrane base to provide for an even equalization of tension within the membrane at every membrane deformation.

6. The process according to claim 4, further comprising gluing the membrane to the resonator and nailing the membrane to the resonator.

7. The process according to claim 4, further comprising fastening the membrane to a rim of the resonator opposite the membrane base.

8. The process according to claim 4, further comprising fastening the membrane to the resonator at an inner area of the resonator.

9. The process according to claim 8, further comprising fastening the membrane to a rim of the resonator opposite the membrane base.

10. A device for tensioning or relaxing a membrane of a musical instrument, especially the membrane of a single-drum-skin frame drum, the membrane lying on a membrane base and connected with a membrane fixing provided at a resonator of the musical instrument, the membrane being pressurizable in a controlled manner using a liquid fluid introduced to at least one variable pressure chamber positioned between the membrane base and the membrane fixing, comprising the membrane forming a wall of the at least one variable pressure chamber, the wall being expandable so that the variable pressure chamber is controllably deformable around a circumference of the membrane to an evenly shaped balloon.

11. The device of claim 10, wherein the walls of the variable pressure chamber are all formed by the membrane.

12. The device of claim 10, wherein a rim of the membrane is glued to the resonator.

13. The device of claim 10, wherein a rim of the membrane is bonded to the resonator.

14. The device of claim 10, wherein a rim of the membrane is fastened to the resonator with one of nails, tacks, pins and threaded fasteners.

15. The device of claim 10, wherein a rim of the membrane is directly connected with a resonator rim directly opposite the membrane base and an inner area of the resonator.

16. A device for tensioning or relaxing a membrane of a musical instrument, especially the membrane of a single-drum-skin frame drum, the membrane lying on a membrane base, being fixed by a membrane fixing provided for at a resonator of the instrument, and being pressurizable in a controlled manner along its circumference by a liquid fluid introduced into a variable pressure chamber formed by an elastically expandable hollow body positioned between the membrane base and the membrane fixing and connected to a liquid fluid source, comprising a drum skin forming the membrane and placed on the resonator, the membrane being pre-formed in a hat-shape and closed in a hoop at a membrane rim, an internal diameter of the hoop being slightly larger than the external diameter of the resonator, the hoop lying against the pressurized hollow body in such a manner that the hoop is held securely and freely vibratable relative to the resonator, thereby fixing the membrane rim tensioned by the hollow body.

17. The device according to claim 16, wherein the hoop is held in place between the pressurized hollow body and an inner surface of the membrane, the membrane rim being held tightly fixed by the hoop against an outer wall of the resonator.

18. The device according to claim 16, wherein the membrane rim is fixed at the lower end of the hoop, forming an outer enclosure of the hollow body such that the hollow body is pressurizing a membrane outer area.

19. The device according to claim 16, wherein the elastically expandable hollow body is one of a bicycle tire tube, a moped tire tube, a wheelchair tire tube and a car tire tube and has a valve.

20. The device according to claim 16, wherein the membrane is formed by an animal drum skin.

21. The device according to claim 16, wherein the membrane is formed by a synthetic material.

22. The device according to claim 16, wherein the membrane base is part of the resonator.

23. The device according to claim 16, wherein the hoop is secured by the variable pressure chamber at the membrane base.

24. The device according to claim 16, wherein the membrane base, the membrane fixing and the variable pressure chamber are all ring-shaped.

25. The device according to claim 16, wherein the variable pressure chamber is connected by a control valve to at least one second pressure chamber, the pressure of which differs from the pressure of the variable pressure chamber.

26. A device for tensioning or relaxing a membrane of a musical instrument, especially the membrane of a single-drum-skin frame drum, the membrane lying on a membrane base, being fixed by a membrane fixing provided for at a resonator of the instrument, and being pressurizable in a controlled manner along its circumference by a liquid fluid introduced into a variable pressure chamber formed by an elastically expandable hollow body positioned between the membrane base and the membrane fixing and connected to a liquid fluid source, comprising the membrane directly connected to a rim of the resonator opposite to the membrane base and to an outer surface of the resonator by an adhesive to ensure the sound variability of the membrane.

* * * * *